US009982446B2

(12) United States Patent
MacNeil et al.

(10) Patent No.: US 9,982,446 B2
(45) Date of Patent: May 29, 2018

(54) FRAME MOUNTED HYDRODEMOLITION SYSTEM FOR TREATING LARGE INCLINED WALL SURFACES

(71) Applicant: MAC & MAC HYDRODEMOLITION INC., Surrey, British Columbia (CA)

(72) Inventors: Gerard J. MacNeil, Surrey (CA); David B. MacNeil, Surrey (CA); Gordon MacNeil, Surrey (CA); Vernon Bose, Surrey (CA); Jesse MacNeil, Surrey (CA); Brett MacNeil, Surrey (CA)

(73) Assignee: MAC & MAC HYDRODEMOLITION INC. (CA)

( * ) Notice: Subject to any disclaimer, the term of this patent is extended or adjusted under 35 U.S.C. 154(b) by 214 days.

(21) Appl. No.: 14/746,348

(22) Filed: Jun. 22, 2015

(65) Prior Publication Data

US 2015/0368920 A1 Dec. 24, 2015

(30) Foreign Application Priority Data

Jun. 23, 2014 (CA) ..... 2855109
Oct. 9, 2014 (CA) ..... 2877055

(51) Int. Cl.
*E04G 3/30* (2006.01)
*E04G 23/08* (2006.01)
(Continued)

(52) U.S. Cl.
CPC ..... *E04G 23/081* (2013.01); *E04G 3/30* (2013.01); *E04G 2003/286* (2013.01); *E21C 25/60* (2013.01)

(58) Field of Classification Search
CPC ..... E21C 25/60; E01C 23/128; E04G 23/081; E04G 3/286; E04G 3/30; E04G 3/325;
(Continued)

(56) References Cited

U.S. PATENT DOCUMENTS 3,661,226 A * 5/1972 Fisher ..... B23K 9/0209 182/142
4,311,293 A * 1/1982 Tenniswood ..... F16G 13/16 248/49
(Continued)

OTHER PUBLICATIONS

"Swedish dam relies on hydrodemolition techniques throughout refurbishment", AQUAJET SYSTEMS AB Job Reports (accessed at www.aquajet.se/hydrodemolition_Job_20.as;) (retrieved Jul. 4, 2014).

(Continued)

*Primary Examiner* — John J Kreck
*Assistant Examiner* — Michael A Goodwin
(74) *Attorney, Agent, or Firm* — Matthew A. Pequignot; Pequignot + Myers

(57) ABSTRACT

A steeply inclined surface is hydrodemolished by providing a staging platform and a rig that includes a base frame defining a planar footprint within the frame. The rig is suspended from the platform by a cable such that frame is coplanar with the surface and the incline of the surface causes the rig to lean against it. Rails are provided on the surface to restrain spurious lateral movement of the rig. The rig is positioned on the surface and nozzles mounted on a trolley within a travelling carriage on the frame travel in two dimensions to hydrodemolish the surface within the footprint. The rig is moved vertically along the rails and laterally along the platform to reposition the rig to work a new section of the surface in conjunction with other rails that are also mounted on the surface.

1 Claim, 9 Drawing Sheets

(51) Int. Cl.
*E21C 25/60* (2006.01)
*E04G 3/28* (2006.01)

(58) Field of Classification Search
CPC .. E04G 2003/286; H02G 11/006; F16G 13/16
See application file for complete search history.

(56) References Cited

U.S. PATENT DOCUMENTS

| | | | | |
|---|---|---|---|---|
| 4,470,952 | A * | 9/1984 | Vassalotti | B08B 9/093 134/167 R |
| 6,179,519 | B1 * | 1/2001 | Hilmersson | B23Q 1/4804 299/1.5 |
| 8,827,373 | B2 | 9/2014 | MacNeil et al. | |
| 2006/0087168 | A1 * | 4/2006 | MacNeil | E04G 23/08 299/17 |
| 2007/0241239 | A1 * | 10/2007 | Utaki | F16G 13/16 248/49 |
| 2011/0185867 | A1 * | 8/2011 | MacNeil | B26F 3/00 83/53 |

OTHER PUBLICATIONS

"Hydrodemolition and Shotcrete for Rehabilitating a Reservoir Spillway", Shotcrete Magazine, Kyong-Ku Yun et al., Published Winter 2013.

* cited by examiner

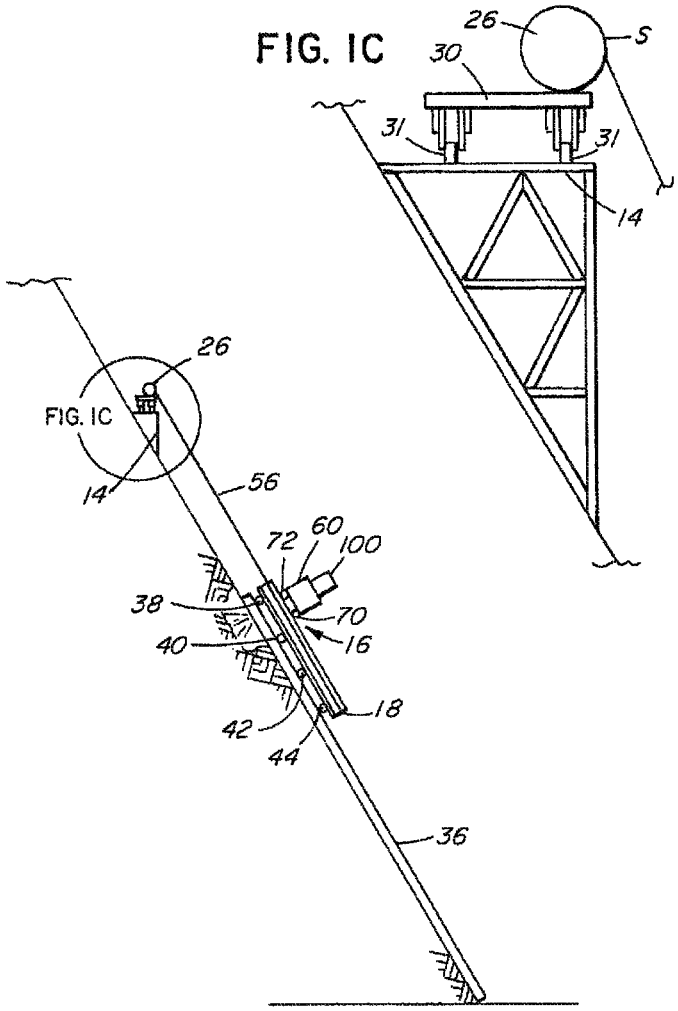
FIG. IB

FRAME MOUNTED HYDRODEMOLITION SYSTEM FOR TREATING LARGE INCLINED WALL SURFACES

RELATED APPLICATION DATA

This application claims priority to Canadian Patent Application No. 2,855,109, filed Jun. 23, 2014, and Canadian Patent Application No. 2,877,055, filed Oct. 9, 2014. All claims of priority to these applications are hereby made, and each of these applications is hereby incorporated in its entirety by reference.

FIELD OF THE INVENTION

This invention relates to the hydrodemolition of large, steeply inclined surfaces. In particular, this invention relates to the hydrodemolition and scarifying of the walls of dams and dam spillways.

BACKGROUND OF THE INVENTION

It is known to use hydrodemolition to scarify a properly vertical wall using a top down approach as described in U.S. Pat. No. 8,827,373 to MacNeil et al. commonly owned with the present application. MacNeil et al. describe a prior art approach of using cables to suspend a worker platform or a cage from the top of the wall enabling personnel to work the surface of the wall below. MacNeil et al.'s application is directed to providing a horizontally elongated rigid support frame supported from the top of the wall and two spaced rails extending downwardly from a top member. Rigidity between the two rails is provided by a nozzle carriage extending between the two rails and that is adapted to move up and down the rails to work the wall surface.

Inclined or steeply inclined walls present a unique set of problems. The incline of the wall would interfere with a properly suspended top-down system while it may also provide potential support for whatever system is to be used. The tension between avoiding the incline of the wall or relying on it for support arises in the context of the hydrodemolition of the walls of dams and dam spillways.

The hydrodemolition of the steeply inclined walls of dams and spillways is sometimes accomplished using a vehicle that travels along the top of the wall. A boom extends from the vehicle down the surface of the wall while a nozzle assembly at the end of the boom works the surface of the wall. Use of such an arrangement is of course limited to walls that are no taller than the reach of the boom.

It is also known to use a vehicle at the bottom of the wall. The vehicle includes a vertical mast and a carriage travels up and down the mast to work the surface of the wall. An image of such an approach can be found at page 2 of the www.aquajet.se/hydrodemolition_job_20.asp. If the boom is to lean into an inclined wall, articulation of the boom must be provided, as well as ensuring that the vehicle does not tip over due to misalignment of the upwardly extending boom.

For vertically curved dam or spillway walls, it is known to mount a pair of temporary curved rails that are spaced above the surface of the wall and that span the height of the wall, tracking its curvature. The rails are secured to the top and the bottom of the wall. A carriage containing a nozzle assembly extends between the opposed rails and is moved vertically along the wall by means of a winch. See *Hydrodemolition and Shotcrete for Rehabilitating a Reservoir Spillway, Shotcrete Magazine*, Winter 2013, p. 49.

Another approach is to use a flat working platform extending horizontally across the spillway surface. The entire platform can be moved up and down the inclined dam spillway surface by means of winches. A wheeled mobile hydrodemolition vehicle travels laterally back and forth along the platform to work the surface using an articulated arm that extends from the vehicle to position a nozzle assembly and associated shroud against the wall surface. Such an approach was used on the Guri Hydroelectric Power Station in Venezuela using a mobile robot by Conjet AB.

It is an object of the present invention to provide an effective system for treating a large and steeply inclined surface by hydrodemolition.

That and other objects of the invention will be better understood by reference to the detailed description of the preferred embodiment which follows. Note that the objects referred to above are statements of what motivated the invention rather than promises. Not all of the objects are necessarily met by all embodiments of the invention described below or by the invention defined by each of the claims.

SUMMARY OF THE INVENTION

In one aspect, the invention comprises a means of hydrodemolishing the surface of a steeply inclined wall.

A frame lying substantially in a plane defines a two dimensional workspace, preferably a rectangular one, within the footprint of the frame. The frame is suspended from above with the plane of the frame parallel to the plane of the surface of the wall so as to overlie a first section of the wall, and with the frame leaning against the wall. Nozzles are movably mounted on the frame or on a carriage on the frame so that the nozzles can travel in at least the two dimensions of the footprint allowing the nozzles to effectively hydrodemolish substantially the entirety of the surface of the wall within the footprint. The frame may be raised and lowered along the vertical extent of the wall and the suspension means for the frame is transversely movable to displace the frame transversely along the width of the wall. The frame is raised or lowered and/or moved transversely to work successive sections of the wall that fall within the footprint of the frame at successive positions of the frame.

The vertical displacement of the frame along the wall is guided by parallel rails mounted along the surface of the wall. During transverse displacement of the frame, the frame may be raised to clear the rails and wheels may be provided on the frame to facilitate the translation of the frame sideways along the wall.

An elongated carriage is displaceable along the vertical extent of the frame, preferably along two spaced side members defining the sides of the rectangular footprint of the frame. A trolley is displaceable along the length of the carriage. The combination of the vertically displaceable carriage and the transversely displaceable trolley (along the length of the carriage) allows nozzles mounted on the trolley to cover the entire footprint of the frame. The working of any given section of the wall involves translating the trolley along the length of the carriage while nozzles mounted on the trolley hydrodemolish the surface of the wall under the trolley. Once the surface of the wall under the length of the carriage has been worked, the carriage is indexed vertically to resume the operation. The process is repeated until the entire footprint of the frame in that position has been worked.

By repeating the process at different frame positions on the surface of the wall, achieved by raising or lowering the frame from the suspension means, tracking the rails on the surface of the wall, and by displacing the frame across the width of the wall by moving the suspension means transversely.

The trolley may comprise a tower extending out of the plane in which the frame lies or other structural means allowing a nozzle cannon to be raised or lowered from the surface of the wall to allow working of the wall to varying depths. The nozzle cannon may comprise three spaced nozzles to provide greater coverage of the surface on each pass of the nozzle cannon.

In the preferred embodiment, the carriage supports two towers, each having a nozzle cannon, each of the two towers reciprocating along one half of the carriage to cooperate to work the length of the wall beneath the carriage.

One challenge in implementing such a system and apparatus is to manage the conduits supplying water and hydraulic control for the displacement of the carriage and the tower(s). In one aspect, the invention comprises a flexible conduit raceway that folds over itself along one of the side members as the carriage moves vertically along the side members of the frame, and an additional raceway that folds over itself as the trolley moves along the length of the carriage.

Preferably the carriage tracks along the side members by means of chains partially housed within chain guides along the side members. One of the side members may further comprise raceway supports.

In a particular aspect, the invention is a method of treating the surface of a large vertically inclined wall by hydrodemolition. A hydrodemolition rig is provided with a frame extending substantially in a plane and defining a substantially rectangular footprint. A carriage is displaceable along side members of the frame and at least one trolley is displaceable along the carriage. A staging platform is mounted above the wall surface. At least one rail is mounted on the surface of the wall. The apparatus is suspended by cables or chains from a movable support on the platform such that the plane of the frame of the rig is parallel to the plane of the wall and the frame leans against the rail or the wall under the influence of gravity. The rail acts to restrain the apparatus from lateral movement. The frame is positioned to overlay a first portion of the wall and the hydrodemolition nozzle(s) are operated in conjunction with movement of the carriage and the trolley to treat substantially the entirety of the first portion of the wall within the footprint defined by the frame. The frame is then repositioned to overlay a second portion of the wall by at least one of raising or lowering the frame in relation to the movable support, moving the support along the platform transversely in relation to the wall such that at least a second rail acts to restrain the apparatus from lateral movement. The nozzle(s) are then operated to treat substantially the entirety of the surface of the second portion of the wall.

In another aspect the invention is a hydrodemolition rig comprising a rectangular frame defined by at least two opposed members. An elongated carriage extends between and for movement along the two opposed members. At least one nozzle-carrying trolley is arranged for reciprocating movement along the length of the carriage. A fluid conduit raceway is supported by the carriage. One end of the raceway is attached to the trolley and the other end is attached to the carriage. The raceway folds over itself or unfolds upon movement of the trolley along the carriage.

The rig may further comprise a second fluid conduit raceway supported by one of the members. A first end is attached to the carriage and a second end is fed by a source of high pressure fluid. The second raceway folds over itself or unfolds upon movement of the carriage along the frame.

In a further aspect, the invention is a hydrodemolition rig comprising a rectangular frame defined by at least two opposed members and has an elongated carriage extending between and for movement along the two members. At least one trolley is arranged for reciprocating movement along the length of the carriage and at least one high pressure fluid nozzle depends from the trolley. A frame is mounted in the trolley for selective movement in a direction that is orthogonal to the carriage and to the opposed members (which would be vertically up and down if the frame were resting on a horizontal surface. At least one high pressure fluid nozzle is mounted on the frame for working an area underlying the trolley.

In another aspect, the invention is a hydrodemolition rig comprising a rectangular frame defined by at least two opposed members and has an elongated carriage extending between and for movement along the two members. Movement of the carriage is by means of a chain or cable attached to the carriage. The chain or cable rests within a channel mounted along at least one of the two members. At least one high pressure fluid nozzle is mounted in association with the carriage whereby movement of the carriage along the two opposed members displaces the fluid nozzle in the same direction The foregoing was intended as a summary only and of only some of the aspects of the invention. It was not intended to define the limits or requirements of the invention. Other and sometimes more particular aspects of the invention will be appreciated by reference to the detailed description of the preferred embodiments. Moreover, this summary should be read as though the claims were incorporated herein for completeness.

BRIEF DESCRIPTION OF THE DRAWINGS

The invention will be described by reference to the detailed description of the preferred embodiment and to the drawings thereof in which:

FIG. 1B is a side elevation of the spillway, the staging platform and the suspended rig;

FIG. 1C is a side elevation of the staging platform showing a winch trolley and one of the winches;

DETAILED DESCRIPTION OF THE PREFERRED EMBODIMENT

The invention will be described by reference to the preferred embodiment thereof as used in the context of hydrodemolition of the surface of a steeply inclined dam spillway. Such hydrodemolition removes a layer of concrete from the spillway wall prior to reapplying concrete to resurface the spillway.

Figure 1:
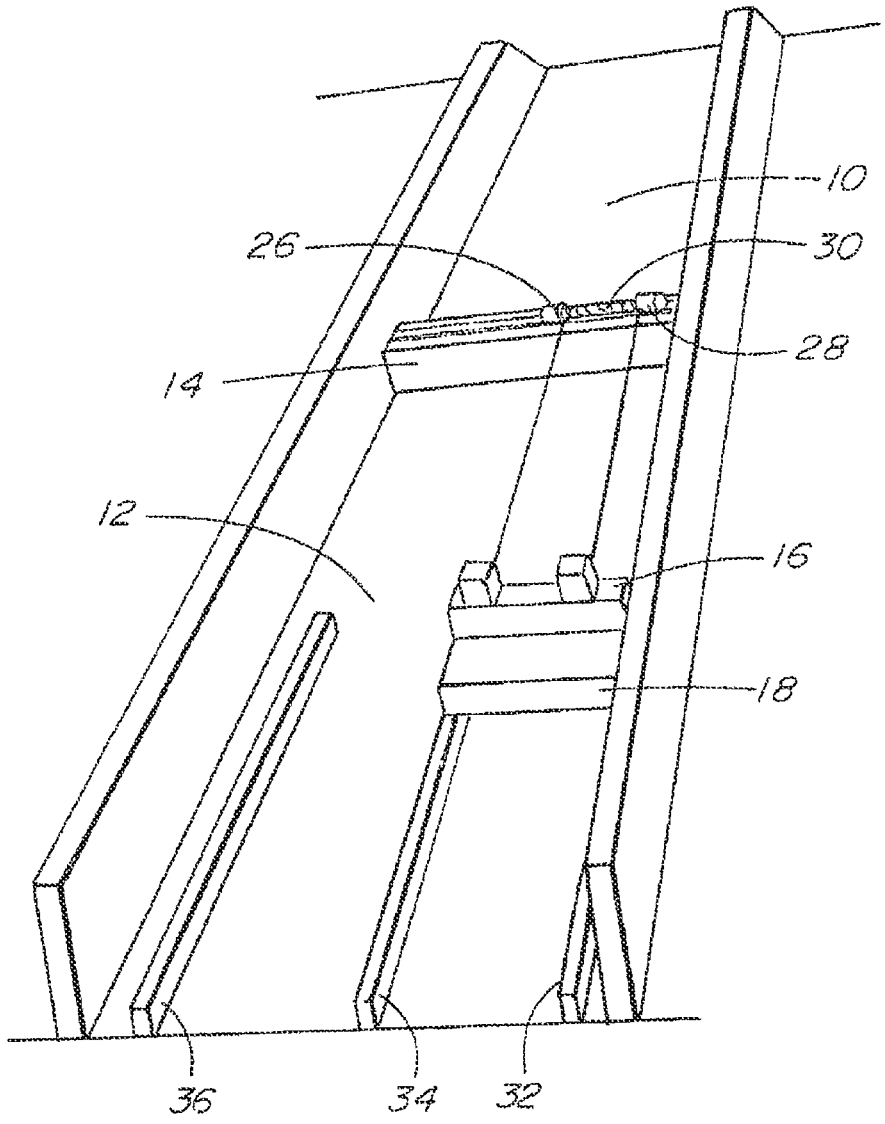
FIG. 1 is a front perspective view of the system according to the preferred embodiment of the invention, mounted on the wall of a dam spillway to cover a first section of the spillway wall, showing the suspension staging platform, a conceptualized version of the hydrodemolition rig and rails mounted on the spillway wall to accommodate vertical travel of the rig.
Figure 1A:
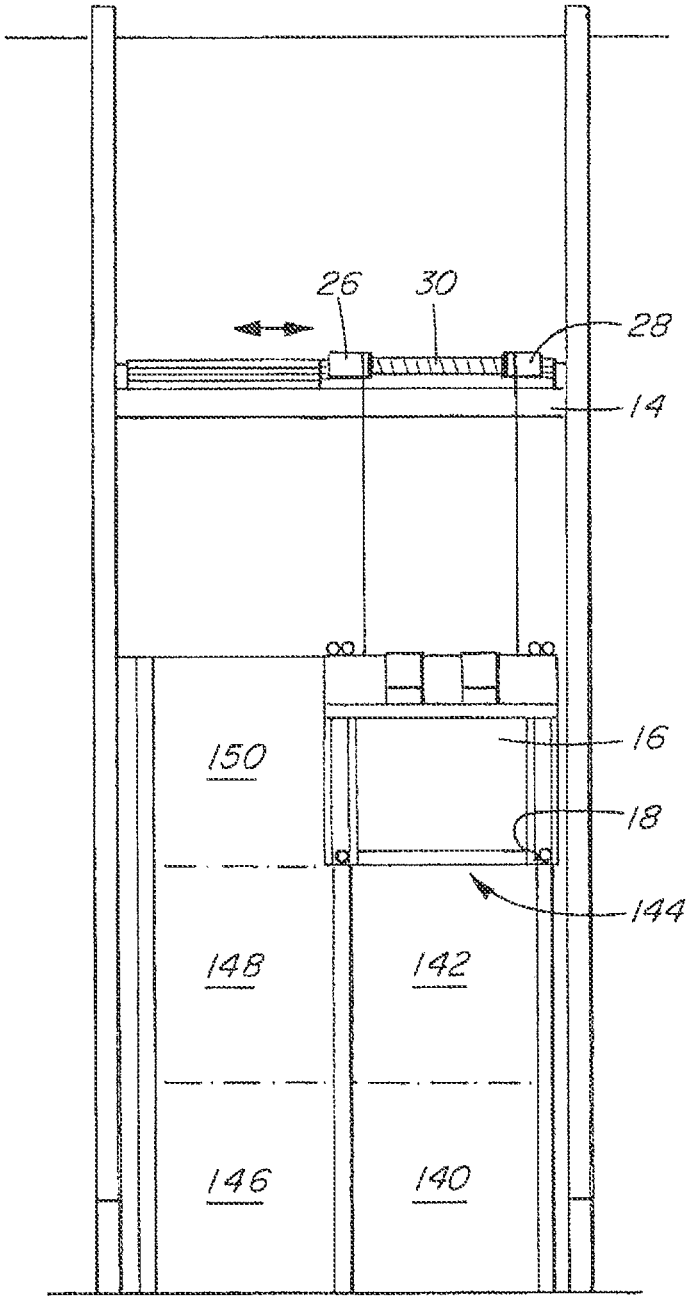
FIG. 1A is a front view of the spillway, the staging platform, surface-mounted rails and the suspended rig according to the preferred embodiment and showing sections of the surface that are intended to be hydrodemolished.
Figure 1D:
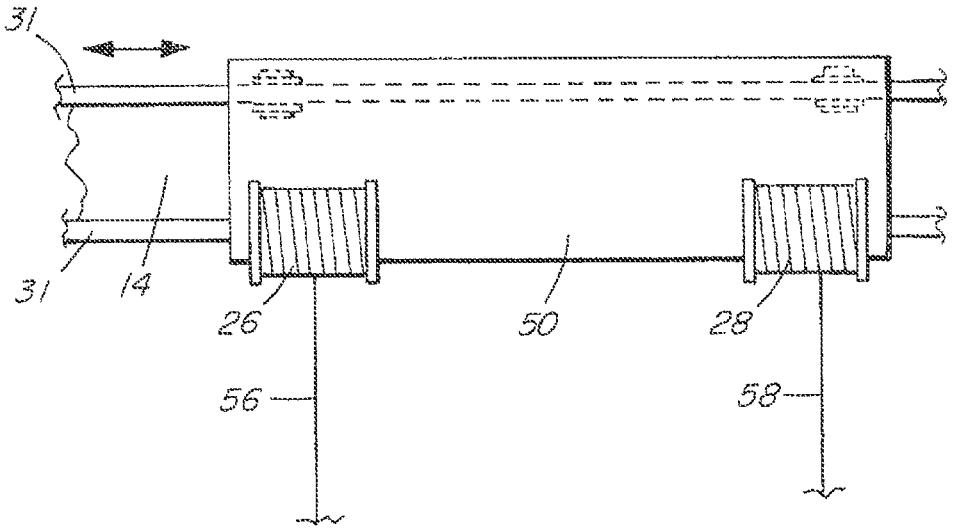
FIG. 1D is a plan view of the winch trolley mounted on rails on the staging platform.

Referring to FIGS. 1 and 1A, a dam spillway 10 may be several hundred feet wide and hundreds of feet high, sometimes at steep angles of between 45° and 10°. In this disclosure and in the claims, references to "vertical", "top", "bottom", "up" or "down" refer to the direction along the incline of the spillway or other inclined surface that is to be treated by hydrodemolition.

In order to hydrodemolish the spillway wall 12, a suspension staging platform 14 is provided to extend transversely along the width of the spillway above the region of the spillway wall that is to be worked. A hydrodemolition rig 16 is suspended from the staging platform 14 to overlie a portion of the spillway wall to be hydrodemolished.

A rigid rectangular base frame 18 of the hydrodemolition rig 16 lies substantially in a plane so as to define a rectangular two dimensional footprint. The frame 18 is suspended from the staging platform 14 such that the plane of the frame 18 is parallel to the surface of the wall while the weight of the rig and the angle of the spillway combine to cause the suspended rig 16 to lean against the spillway wall as best seen in FIG. 1B.

The rig 16 includes hydrodemolition nozzles 20, 22, 24 (best seen in FIG. 3) that travel along the vertical and transverse directions within the frame 18 to hydrodemolish substantially all of the wall surface 12 that lies within the rig's footprint as the rig 16 rests in a given position against the surface of the wall. Once the complete surface of the wall within the footprint has been hydrodemolished, the rig is moved to another position on the wall where the hydrodemolition process is repeated.

The rig 16 is suspended from the staging platform 14 by means of a cable winch system that is mounted on the staging platform 14 and that is transversely movable along the staging platform. Preferably the winch system consists of two spaced winches 26, 28, each winch having one cable attached to the frame 18 of the rig 16, and both winches being mounted on a common trolley 30. The trolley travels along a trolley track 31 so as to selectively locate the trolley at different transverse positions along the staging platform enabling the displacement of the suspended rig transversely along the width of the wall. The rig 16 is raised or lowered and/or moved transversely across the wall to position the rig to work successive sections of the wall within the footprint of the frame at each rest position of the rig 16.

The vertical displacement of the frame along the wall is guided by spaced parallel rails 32, 34, 36 that have been secured along the surface of the spillway below the staging platform 12 for the purposes of the hydrodemolition operation. The rig is stabilized against spurious lateral movement during the hydrodemolition process by engaging rollers 38, 40, 42, 44 (that are provided on each side member of the frame 18) onto the rails, or alternatively by abutting the rollers against the sides of the rails.

During transverse displacement of the frame, the frame 18 is raised to clear the rails. Suitably oriented extendible and retractable wheels may be provided on the frame to facilitate the translation of the frame 18 sideways along the wall and over the rails.

Figure 2:
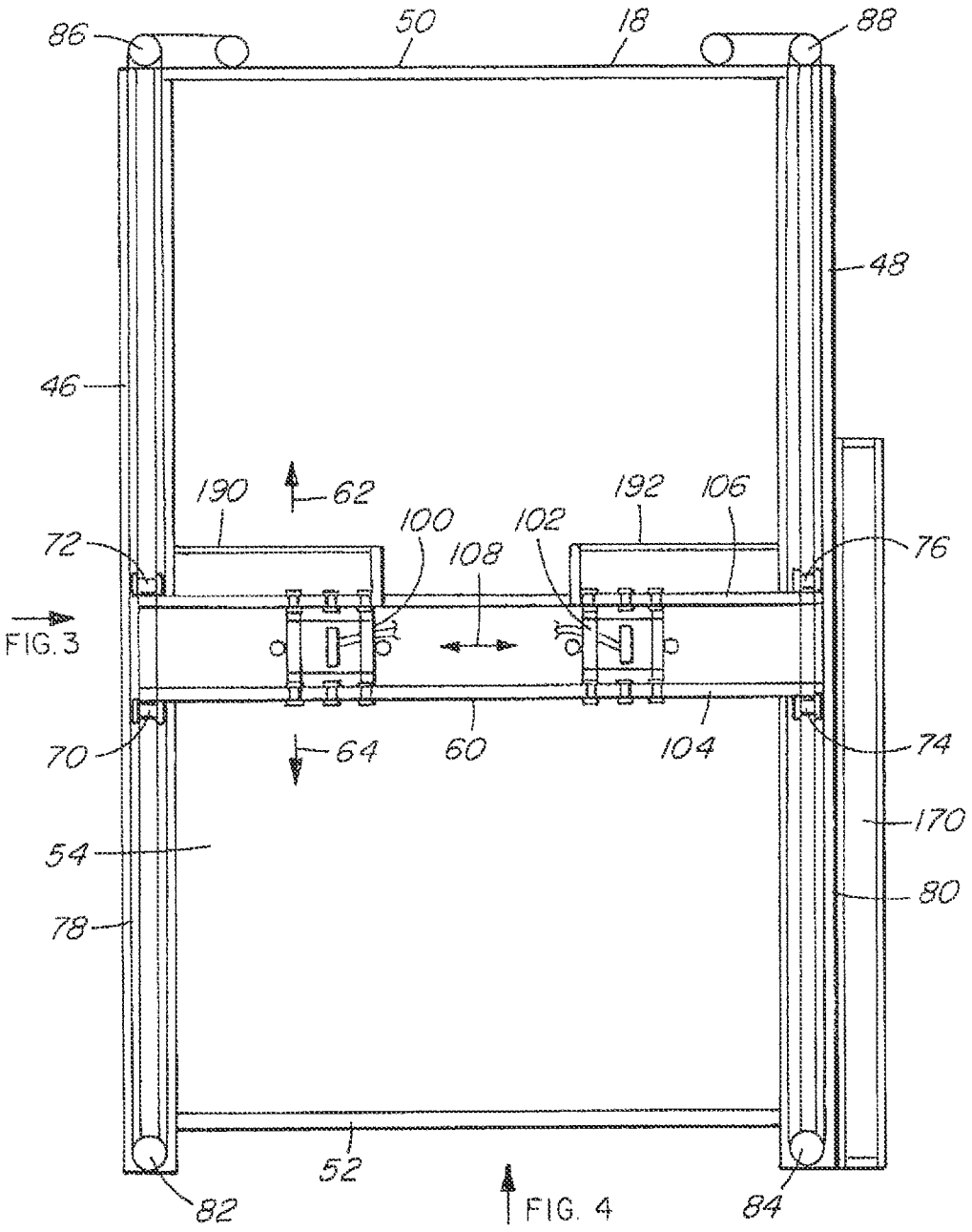
FIG. 2 is a plan view of the hydrodemolition rig.

Referring principally to FIG. 2, the frame 18 consists of two opposed spaced vertical side members 46, 48 the ends of which are joined by opposed horizontal top and bottom cross beams 50, 52 such that the frame 18 extends substantially along a plane to define a rectangular workspace within the footprint 54 of the frame. Horizontal cross beam 50 includes anchors for attaching the cables 56, 58 that suspend the rig 18 from the winches 26, 28 in the manner shown in FIG. 1A.

Referring to FIG. 2, an elongated carriage 60 extends between side members 46, 48 and includes rollers 70, 72 and 74, 76 at the ends of the carriage 60 to enable the carriage to ride along the side members 46, 48 as indicated by arrows 62, 64. It will be appreciated that when the rig 16 is suspended from the staging platform 14, such movement is vertical (as defined herein) in relation to the spillway wall.

The carriage 60 is raised or lowered (arrows 62, 64) along the side members 46, 48 by means of chains 78, 80 that extend from sprockets 82, 84, 86, 88 at the top and bottom of the side members. The chains 78, 80 are guided within channels 90 (see FIG. 5) mounted on the side members 46, 48 and the weight of the chains 78, 80 and the incline of the rig 16 resting against the spillway acts to retain the chains that rest within the channels.

The carriage 60 comprises at least one and preferably two trolleys 100, 102 that are displaceable horizontally along respective sections of the length of the carriage 60 (in the direction of elongation of the carriage). The combination of the vertically displaceable carriage 60 and the transversely displaceable trolleys 100, 102 allows high pressure hydrodemolition nozzles 20, 22, 24 (see FIG. 3) mounted on the trolleys to cover the entire footprint 54 of the frame 18.

Figure 6:
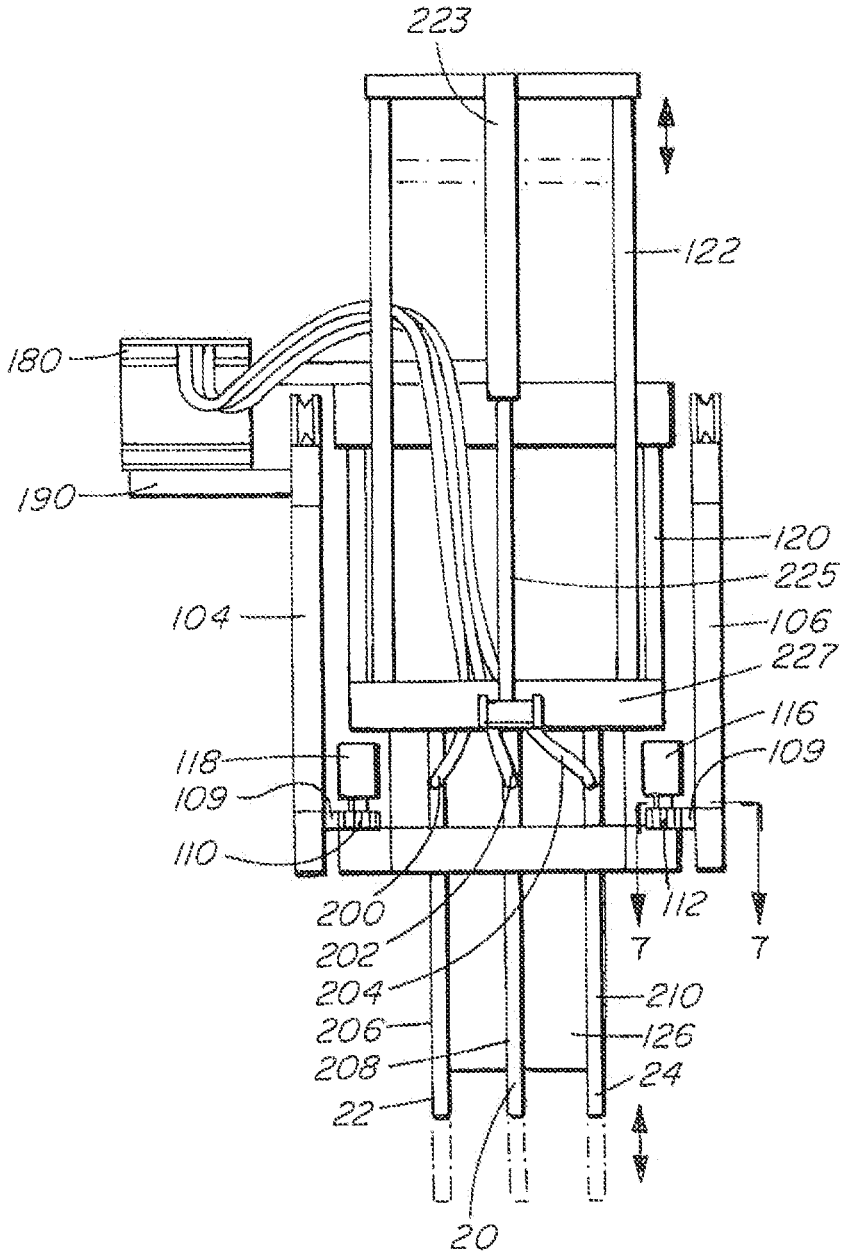
FIG. 6 is a cross-sectional view of the carriage and including a side elevation of a trolley mounted for movement along the length of the carriage (into and out of the page)
Figure 6A:
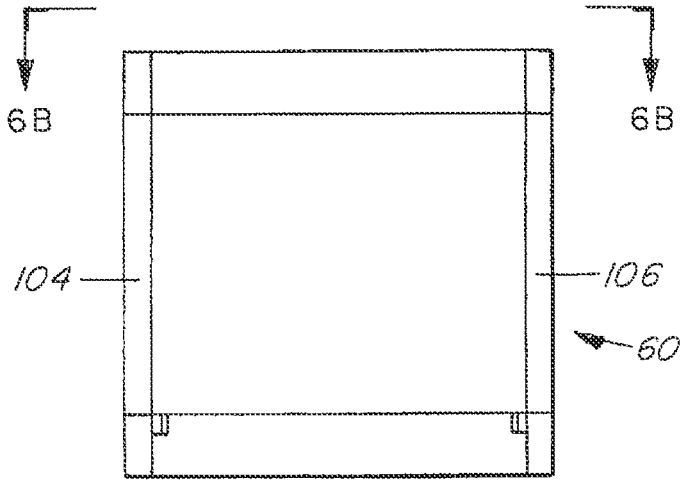
FIG. 6A is a view taken along 6A-6A of FIG. 4 showing only the carriage but omitting the trolley and the base frame.
Figure 6B:
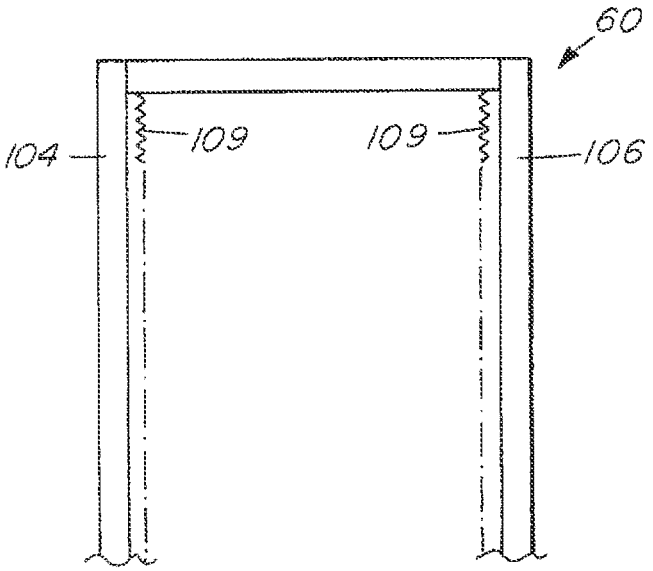
FIG. 6B is a plan view of the carriage only, taken along 6B-6B of FIG. 6A.
Figure 7:
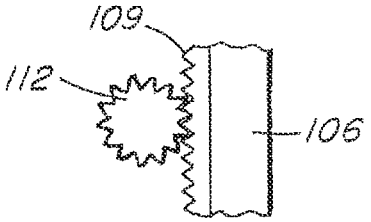
FIG. 7 is a view taken along 7-7 of FIG. 6.

The carriage 60 comprises two spaced walls 104, 106 defining a gap between them to accommodate the travel of trolleys 100, 102 along the length of the carriage 60 in the direction shown by arrow 108. Referring to FIG. 6, a rack 109 is mounted on the inner side of each wall 104, 106 of the carriage 60 to cooperate with pinions 110, 112 mounted on the trolleys 100, 102 to drive the trolleys along the length of the carriage 60.

Each trolley consists of a tower 120 extending out of the plane in which the frame 18 lies. Pinions 110, 112 at opposed sides of the tower 100 engage racks 109 on the carriage walls 104, 106 while drives 116, 118 actuate the pinions under the control of a controller (not shown) to propel the trolley along the gap in the carriage along direction 108.

A cannon frame 122 is mounted within the tower 120 for selective movement into or out of the plane of the frame (direction 124 in FIG. 3) and a nozzle cannon 126 is mounted on the cannon frame 122. By moving the cannon frame 122 along the tower 120 in a direction that is orthogonal to both the carriage and to the to opposed frame members 46, 48, the nozzle cannon 126 can be raised or lowered from the surface of the wall to allow working of the wall to varying depths. According to the preferred embodiment, the cannon frame 122 slides along the inside corners of the trolley tower 120, a hydraulic cylinder 223 actuating the piston 225 which is attached to a cross-member 227 of the trolley tower 120.

Nozzle cannon 126 includes three spaced nozzles 20, 22, 24 aligned along the width of the carriage 60 to provide greater coverage of the surface on each pass of the nozzle cannon 126 than would a single nozzle. High pressure water lines 200, 202, 204 feed to the tops of conduits 206, 208, 210 provided on the nozzle cannon 126.

The working of any given section of the wall involves translating the trolleys 100, 102 along the length of the carriage 60 while nozzles 20, 22, 24 mounted on the trolleys hydrodemolish the surface of the wall underlying the carriage. Once the surface of the wall under the length of the carriage has been worked, the carriage is indexed vertically (62, 64) a suitable distance to repeat the operation. The process is repeated until the entire footprint 54 of the frame 18 in that position has been worked to remove a layer of concrete as at 130 in FIG. 3.

In the preferred embodiment, each of the two trolleys (each having a nozzle cannon), reciprocates along one half of the length of the carriage to cooperate to work the length of the wall beneath the carriage however it is within the scope of the invention to provide a single trolley that reciprocates the entire length of the carriage 60.

The winches 26, 28 raise and lower the frame to reposition it so that different vertical sections of the spillway can be worked. In one example, the entire frame is placed first on a lowermost section 140 of the spillway for which the surface of the wall is to be hydrodemolished. Once lowermost section 140 is scarified, the winches 26, 28 are used to raise the rig 16 to the next vertical section 142. Once a column of targeted vertical sections 140, 142, 144 have been entirely scarified, retractable wheels on the underside of cross beams 50, 52 are extended to raise the rig 16 off the rails 32, 34 that are mounted on the spillway surface. The winch trolley 30 is then rolled laterally along the staging platform 14 while the wheels on cross beams 50, 52 support the rig 16 as it rolls laterally across the wall 12. The rig 16 is then installed on a new pair of rails 34, 36 that correspond to the position of the new vertical sections 146, 148, 150 of wall to be scarified.

Figure 3:
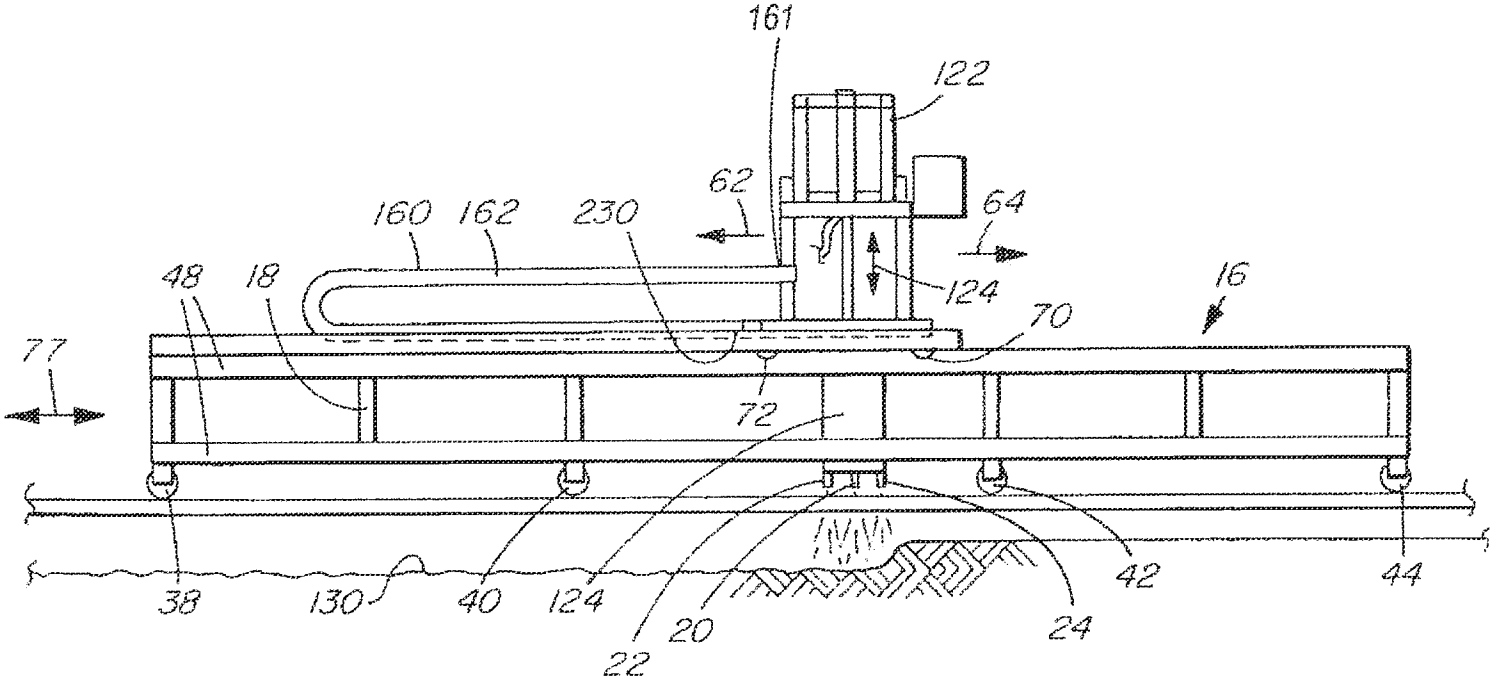
FIG. 3 is a side elevation of the hydrodemolition rig.
Figure 5:
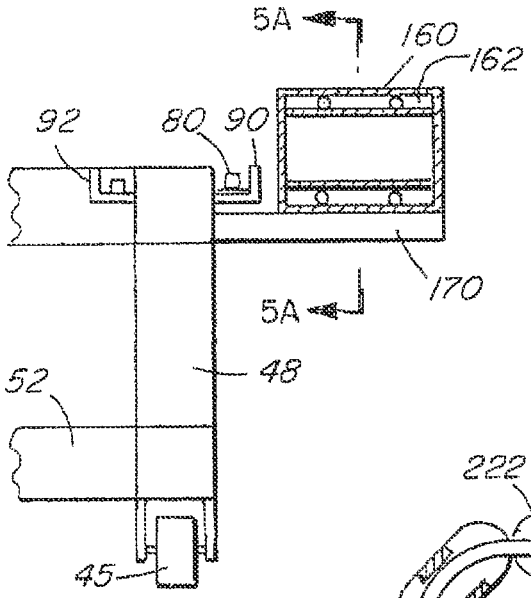
FIG. 5 is an enlarged view of a side member of the frame also showing the chain channels for the chain that draws the carriage along one of the side members and further showing a raceway and raceway support.
Figure 5A:
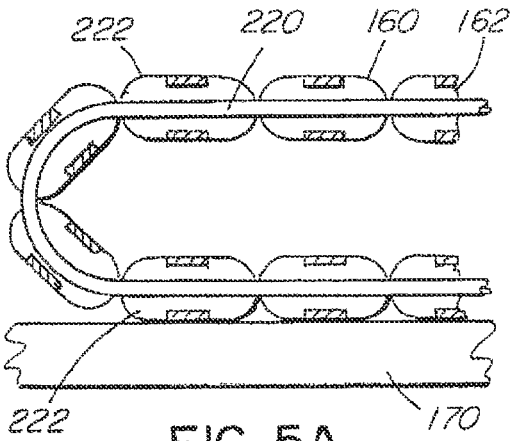
FIG. 5A is a view taken along 5A-5A of FIG. 5.

One challenge in implementing such a system and apparatus is to manage the conduits supplying water and hydraulic control for the displacement of the carriage and the tower(s). Referring to FIGS. 3, 5 and 5A, a flexible conduit raceway 160 having an interior cavity 162 is supported by one of the side members 48. A first end 161 of the raceway 160 is attached to the carriage 60 and the second end of the raceway is connected to a high pressure fluid source supplying the rig. As the carriage 60 moves to the right in FIG. 3, in other words in the direction of the second end of the raceway, the raceway 160 folds over itself and unfolds as the carriage moves in the opposite direction. Additional conduit raceways 180, 182 associated with the trolleys fold or unfold over themselves as each trolley 100, 102 moves along the length of the carriage 60.

Figure 4:
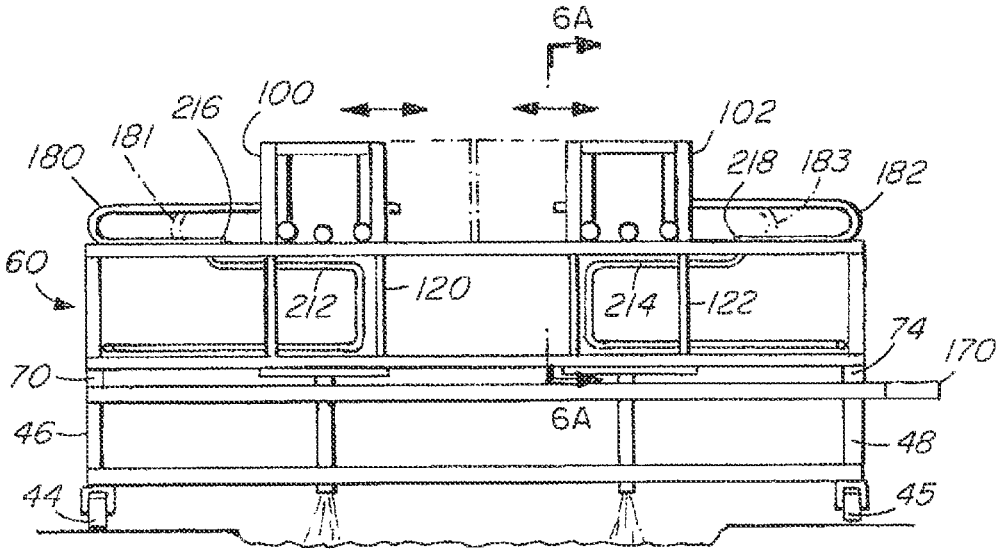
FIG. 4 is a view taken along the direction indicated as 4-4 in FIG. 2.

For example, reference numerals 181 and 183 in FIG. 4 illustrate alternative positions of the flexible trolley raceways for different trolley positions. Supply line bundles 212, 214 feed into the raceways at ends 216, 218 of the raceways that are fixed to the carriage 60 while the other end of raceways 180, 182 are attached to the trolleys. As a trolley moves away from the end that is attached to the carriage, the raceway folds over itself.

The flexible hydraulic and high pressure water supply conduits (for example 220 in the frame-supported raceway of FIG. 5A) are housed within the cavity 162 of the flexible raceway, whose flexibility is enabled by articulating links 222. In the case of the frame-supported carriage raceway 160, an end 230 of the carriage raceway 160 that is proximal to the fluid supply may be fixed to the frame 18 while opposed end of the raceway is fixed to the carriage 60. The ends of the raceways that are proximal to the moving part (the carriage or the trolley) draw the raceways and cause them to fold or unfold onto themselves as they are drawn along.

Side member 48 includes a raceway support 170 extending to the outboard side of side member 48 to receive the raceway 160 when the carriage extends toward cross beam 52. Raceways 180 and 182 for the trolleys 100 and 102 are supported by raceway supports 190, 192 extending on the outboard sides of the carriage 60.

In the foregoing specification, the invention has been described with reference to specific embodiments thereof. However, the scope of the claims should not be limited by the preferred embodiments set forth in the examples, but should be given the broadest interpretation consistent with the description as a whole. The specification and drawings are, accordingly, to be regarded in an illustrative rather than a restrictive sense.

For example, in the event that the portion of the spillway wall that is to be worked does not extend the full width of the spillway 10, the platform 14 need only extend such distance along the width of the spillway that corresponds to the width of the wall to be worked. In the illustrated embodiment, the entire width of the spillway 10 is to be worked and accordingly, in the drawings of the preferred embodiment, the staging platform 14 extends across the entire width of the spillway. Appropriate outriggers and counterweights for the staging platform may also be used.

The number and spacing of rails depends on the size of the rig 16 and the width of the spillway 10 to be worked. The rig 16 may even be guided by a single rail at a time if the connection of the rig to the rail is sufficiently stable to both guide the rig vertically and to keep the rig stable during the hydrodemolition process.

The frame has been described as defining a rectangular footprint. In this disclosure and in the claims, "rectangular" includes a square shape.

It will be appreciated that other constructional details may also be varied as required to achieve the objects of the invention.

The invention claimed is:

1. A method of treating the surface of a vertically inclined wall by hydrodemolition, comprising:

providing a hydrodemolition apparatus having a frame extending in a plane and defining a rectangular footprint, a carriage displaceable along side members of said frame, at least one trolley displaceable along said carriage and at least one hydrodemolition nozzle;

providing a staging platform above said wall surface;

providing at least one rail mounted on the surface of said wall;

supporting the weight of said apparatus on said surface by rollers on said frame;

suspending said apparatus by cables or chains from a movable support on said platform such that said plane is parallel to a plane of said inclined wall and said frame leans against said at least one rail or said wall under the influence of gravity such that said hydrodemolition apparatus is supported by said at least one rail or said wall, said at least one rail acting to restrain said apparatus from lateral movement;

positioning the frame to overlay a first portion of the wall;

operating said at least one hydrodemolition nozzle, said at least one trolley and said carriage to treat the entirety of said first portion within said footprint;

repositioning the frame to overlay a second portion of the wall by at least one of: raising or lowering said frame in relation to said movable support, moving said movable support along said platform transversely in relation to said wall such that at least a rail other than said at least one rail acts to restrain said apparatus from lateral movement; and, operating said at least one hydrodemolition nozzle to treat the surface of said second portion of the wall.

* * * * *